US005301520A

United States Patent [19]

Kitamura et al.

[11] Patent Number: 5,301,520

[45] Date of Patent: Apr. 12, 1994

[54] WATER REMOVING DEVICE IN REFRIGERATING SYSTEM

[75] Inventors: Keiichi Kitamura, Handa; Shin Honda, Nagoya; Hisayoshi Sakakibara, Nishio; Masashi Honda, Okazaki, all of Japan

[73] Assignee: Nippondenso Co., Ltd., Kariya, Japan

[21] Appl. No.: 868,301

[22] Filed: Apr. 14, 1992

[30] Foreign Application Priority Data

| | | | |
|---|---|---|---|
| Apr. 15, 1991 | [JP] | Japan | 3-082675 |
| Dec. 26, 1991 | [JP] | Japan | 3-345134 |
| Feb. 5, 1992 | [JP] | Japan | 4-020313 |

[51] Int. Cl.[5] ..... F25B 43/04

[52] U.S. Cl. ..... 62/475; 62/85; 62/474

[58] Field of Search ..... 62/85, 474, 475

[56] References Cited

U.S. PATENT DOCUMENTS

| | | | |
|---|---|---|---|
| 4,417,451 | 11/1983 | Spauschus | 62/475 X |
| 4,476,688 | 10/1984 | Goddard | 62/475 X |
| 4,683,724 | 8/1987 | Vergel, Jr. | 62/85 |
| 5,027,642 | 7/1991 | Wen et al. | 62/85 X |
| 5,044,166 | 9/1991 | Wijmans et al. | 62/475 X |
| 5,062,273 | 11/1991 | Lee et al. | 62/475 X |
| 5,138,847 | 8/1992 | Rollins | 62/474 X |

FOREIGN PATENT DOCUMENTS

| | | | |
|---|---|---|---|
| 2024088 | 8/1970 | France | 62/475 |
| 0140248 | 10/1979 | Japan | 62/475 |
| 59-93172 | 5/1984 | Japan . | |
| 59-157462 | 9/1984 | Japan . | |
| 2-146477 | 6/1990 | Japan . | |
| 2-287066 | 11/1990 | Japan . | |
| 0025265 | 2/1991 | Japan | 62/474 |
| 3-125873 | 5/1991 | Japan | 62/474 |

*Primary Examiner*—Henry A. Bennet
*Assistant Examiner*—C. Kilner
*Attorney, Agent, or Firm*—Cushman, Darby & Cushman

[57] ABSTRACT

There is used a refrigerant which is lower in a saturated water concentration in gas phase than in liquid phase, such as, for example, Freon-134a or Freon-22. In a body block 46 of a box-shaped expansion valve there are formed by-passes 77, 81 and 86 for by-passing a portion of the refrigerant evaporated in an evaporator 41. Halfway in the by-passes 77, 81 and 86 a cooling cylinder 73 is disposed for cooling the refrigerant present in those by-passes, and further a filter 83 is disposed for collecting the water contained in the refrigerant. In addition, a water permeating membrane 88 is disposed in a water discharge passage 79 formed in the body block 46.

15 Claims, 15 Drawing Sheets

WATER REMOVING DEVICE IN REFRIGERATING SYSTEM

BACKGROUND OF THE INVENTION

The present invention relates to a water removing device for removing water contained in a refrigerant in a refrigerating system used in an air conditioner or the like.

When water is mixed in a refrigerant, it causes various inconveniences such as internal corrosion of a metallic portion which is in contact with the refrigerant, deterioration of the cooling performance due to freezing in an expansion device, and a trouble of a compressor caused by the compression of liquid. In an automobile air conditioner, since rubber hoses are used in various portions for absorbing vibration, water is apt to enter the refrigerant through those rubber hoses. Japanese Patent Laid Open No. 157462/84, shows that a refrigerant is cooled by a cold trap using liquid nitrogen to cool the refrigerant and freeze water contained in the refrigerant, then the water is removed.

However, the cold trap requires a cooling device for obtaining the liquid nitrogen at ultra-low temperature and hence it has been difficult to provide the cooling device in a limited mounting space Japanese Patent Laid Open No. 146477/90, shows another refrigerating system wherein a refrigerant is branched from a refrigerant pipe in a portion which becomes high in both temperature and pressure due to compression by a compressor and the thus-branched refrigerant is cooled by the refrigerant whose temperature became low in an expansion valve. A water recovering device is provided in the portion where the branched refrigerant is cooled, whereby the water dissolved in the refrigerant is separated and recovered by glass wool. In this refrigerating system Freon-12 (CFC-12) is used as refrigerant, which has a property such that the higher the temperature, the larger the amount of water dissolved therein, and a saturated water concentration is higher in gas phase than in liquid phase.

In such refrigerating system, however, it is necessary to pass a branch pipe for cooling through an outlet side portion of the expansion valve and connect a return pipe to an inlet side portion of the same valve. There have been problems; for example, the laying of the branch pipe is difficult, and the conditions for heat exchange to remove water in the water recovering device are changeable depending on various factors, including whether the cooling load is large or small, so it is difficult to set a cooling area of the refrigerant. In other words, in the refrigerating system in question, water is removed only under specific conditions, while under other conditions the removal of water is not effected smoothly.

In such refrigerating system, moreover, there has been a problem such that in the case of using a refrigerant, for example Freon-134a (HFC-134*a*), Freon-22 (CFC-22) which is higher in saturated water concentration in liquid phase than in gas phase, contrary to Freon-12, there is not obtained a satisfactory water removing performance. More particularly, even if water which could be separated from a liquid refrigerant by branching and cooling is recovered completely by glass wool, water will be formed and freeze in a gaseous refrigerant which is formed after adiabatic expansion in the expansion valve, thus causing inconvenience.

Further, in the water separating device disclosed in Japanese Patent Laid Open No. 287066/90, an opening is formed in part of the peripheral wall of a refrigerant circulating passage, and a water permeating membrane which permits only the water contained in a refrigerant to pass therethrough is disposed in the said opening. Also disposed in the opening is a casing, with a desiccant contained therein.

In such water separating device, since water is recovered from only the refrigerant which is in contact with the water permeating membrane, there arises the necessity of enlarging the area of the opening in order to enhance the water recovering efficiency. However, even if the opening is made large, the separation of water is not so effective because the water permeating membrane is disposed in parallel with the refrigerant flowing direction and further because water passes in a dissolved state in the refrigerant.

SUMMARY OF THE INVENTION

An object of the present invention is to achieve an effective removal of water contained in a refrigerant without complicating the laying of pipe.

In one aspect of the present invention, the water removing apparatus includes a by-pass passage for by-passing a part of the refrigerant evaporated in an evaporator, and a water collector disposed in the said by-pass passage to collect the water contained in the refrigerant. The saturated water concentration of the refrigerant is lower in gas phase than in liquid phase.

A cooler may be used so as to cool the refrigerant passing through the by-pass.

Further, a permeating membrane which discharges the collected water into the air on the basis of a difference between a partial pressure of steam inside the membrane and that outside the membrane may be disposed between the air and the refrigerant passage in a position close to the water collector.

In another aspect of the present invention the water removing apparatus includes a by-pass passage for by-passing a portion of the refrigerant flowing through a main pipe in the refrigerating cycle, an expansion chamber disposed in the by-pass for adiabatic expansion of the refrigerant passing through the by-pass and separation of water, and a water collector disposed in the expansion chamber to collect the separated water. The saturated water concentration of the refrigerant is lower in gas phase than in liquid phase.

Between the expansion chamber and the air a permeating membrane may be disposed, which discharges the collected water into the air on the basis of a difference between a partial pressure of steam in the expansion chamber and that in the air.

The by-pass passage may be provided between an outlet side of an evaporator and an inlet side thereof, or between an upstream side of an evaporative pressure regulating valve and a downstream side thereof, or between an outlet side of a receiver and an inlet side of a compressor, or between the outlet side of the receiver and an inlet side of the evaporator, or between an outlet side of an expansion valve and the inlet side of the compressor, or between the outlet side of the expansion valve and the inlet side of the evaporator.

Additionally, an inlet pipe may be provided on an inlet side of the by-pass passage in a projecting state into the main pipe to introduce the refrigerant into the by-pass passage; an outlet pipe may be provided on an outlet side of the by-pass passage in a projecting state into the main pipe to create a by-pass flow under an ejector effect; further, on the outlet side of the by-pass passage, a constriction may be provided in the main pipe to increase the flowing velocity of the refrigerant and create a by-pass flow.

In the water removing device of the present invention having the above construction, since the refrigerant has the property that the saturated water concentration thereof in gas phase is lower than that in liquid phase, the water dissolved in the refrigerant is separated at the time of evaporation of the refrigerant in the evaporator, and the separated water is collected by the water collector.

Further, by disposing a cooler halfway in the by-pass passage it is made possible to effect a further removal of water from the refrigerant in which the water is dissolved as an excess portion corresponding to the degree of superheat at the outlet of the evaporator.

The water collected by the water collector is discharged into the air through the specific substance permeating membrane when the refrigerating cycle is stopped.

In the water removing device of the present invention, moreover, the refrigerant which is circulating in the refrigerating cycle is introduced into the by-pass passage due to a pressure difference between the inlet side of the by-pass and the outlet side thereof. The saturated water concentration of the refrigerant introduced into the by-pass is lower in gas phase than that in liquid phase, and the amount of water dissolved in the refrigerant in gaseous state depends on pressure and temperature. The higher the pressure, or the higher the temperature, the amount of dissolved water increases. Therefore, the refrigerant undergoes an adiabatic expansion in the expansion chamber disposed halfway in the by-pass and becomes a refrigerant of gas phase or gas-liquid two phases having low temperature and pressure. As a result of such gasification and lowering of temperature, the water which has been dissolved in the refrigerant is separated. This separated water is then collected by the water collector.

Further, the water thus collected by the water collector is discharged into the air through the permeating membrane when the refrigerating cycle is stopped.

Moreover, an optional arrangement can be made if the by-pass passage is connected between portions where a pressure difference arises. Additionally, if a member for facilitating the creation of a by-pass flow is disposed on the inlet or outlet side of the by-pass, a portion of the refrigerant flowing through the main pipe can be branched more surely.

DETAILED DESCRIPTION OF THE PREFERRED EMBODIMENTS

Embodiment 1

A first embodiment of the present invention is described below with reference to FIGS. 1 to 7.

Figure 1:
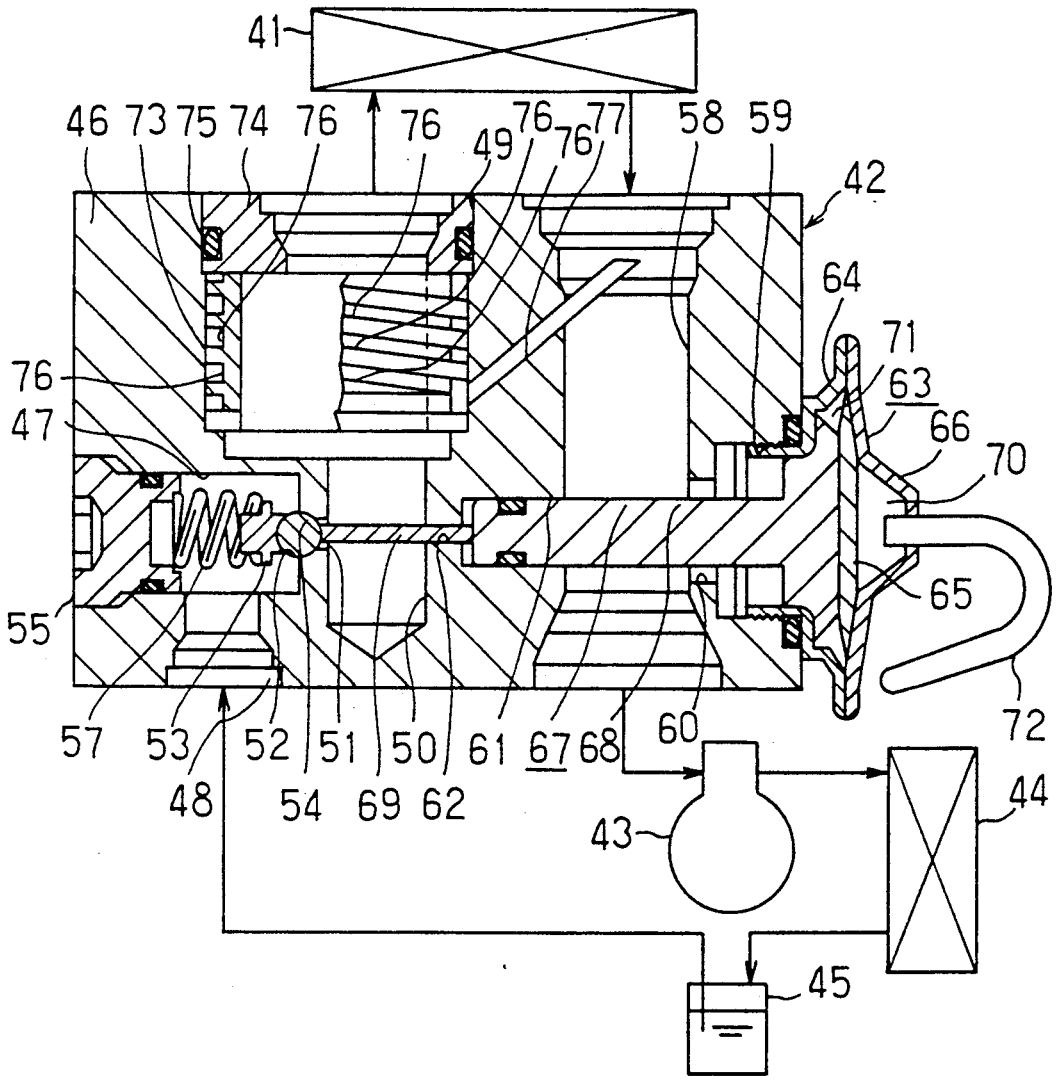
FIG. 1 is a sectional view of a refrigerating system according to a first embodiment of the present invention.
Figure 2:
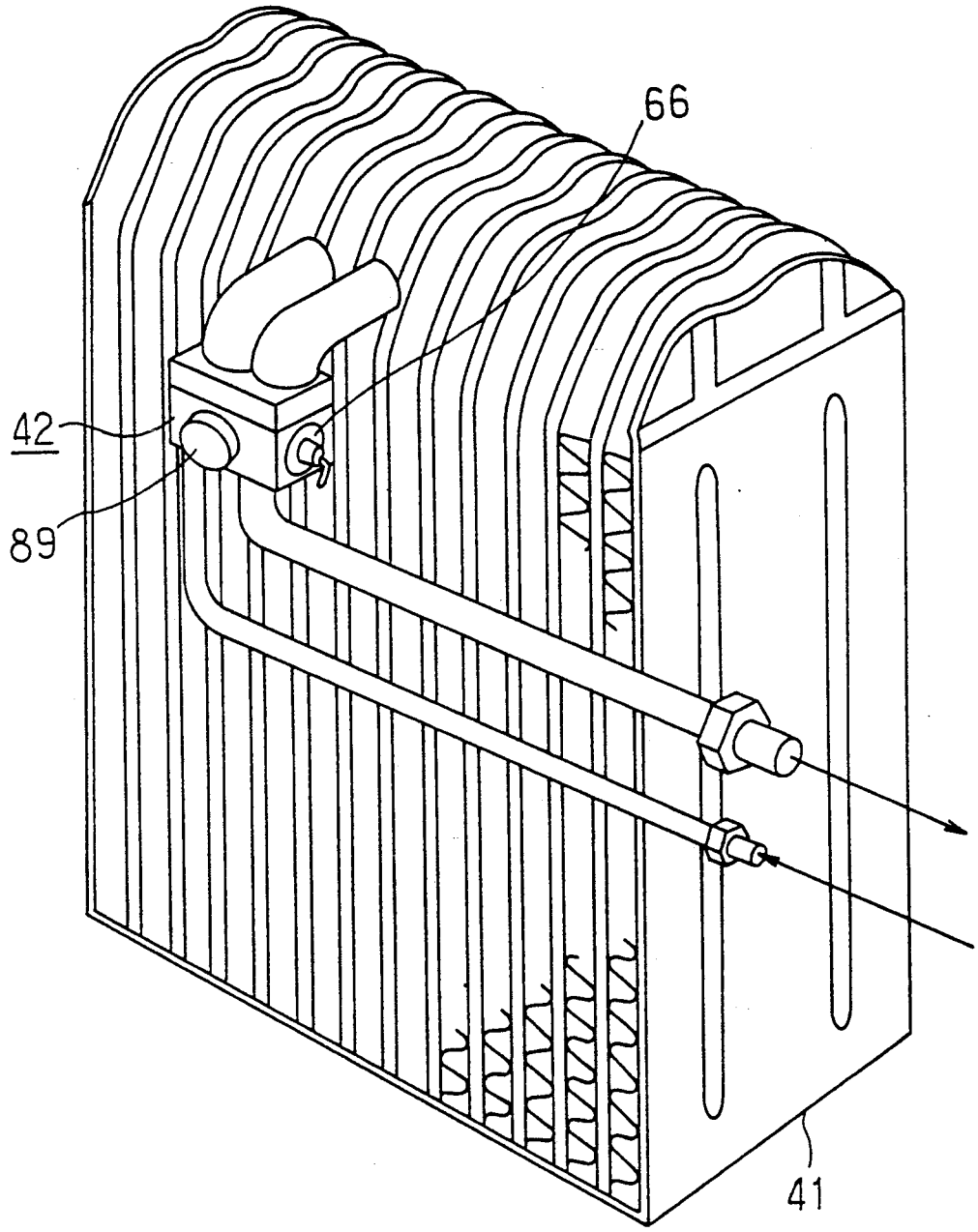
FIG. 2 is a perspective view showing a box-shaped expansion valve and an evaporator.

As shown in FIGS. 1 and 2, an automobile air conditioner is provided with an evaporator 41, a box-shaped expansion valve (hereinafter referred to simply as "expansion valve") 42, a variable capacity compressor (simply "compressor" hereinafter) 43, a condenser 44 and a receiver 45. A valve chamber 47 is formed in the lower portion on one side (left-hand side in FIG. 1) of a body block 46 of the expansion valve 42. The valve chamber 47 extends front an outer side face of the body block 46 and is in communication with a first refrigerant passage 48 into which the refrigerant can flow from the receiver 45. A circular recess 49 is formed in the body block 46, and a second refrigerant passage 50 extends from the bottom of the recess 49. The second refrigerant passage 50 is in communication with the valve chamber 47 through an expansion orifice 51.

A valve seat 52 is formed on the valve chamber 47 side of the expansion orifice and a valve body 54 integral with a valve holder 53 is adapted to move into and out of contact with the valve seat 52 to open and close the expansion orifice 51. The valve chamber 47 is closed with a spring shoe 55, and a compression coiled spring 57 is interposed between the spring shoe 55 and the valve holder 53. Consequently, the valve body 54 is urged in a direction to close the orifice 51 by means of the compression coiled spring 57.

A third refrigerant passage 58 is formed through the other side portion (right-hand portion in FIG. 1) of the body block 46.

A threaded hole 59 is formed in the lower portion of the other side of the body block 46 and it is in communication with a the third refrigerant passage 58 through a plunger hole 60, so that the refrigerant in the third refrigerant passage 58 can flow into the threaded hole 59 through the plunger hole 60. A plunger hole 61 extends from the inner wall surface of the third refrigerant passage 58 toward the second refrigerant passage 50. The plunger hole 61 and the second refrigerant passage 50 are communicated with each other through a rod hole 62.

An opening adjusting member 63 for adjusting the opening of the expansion orifice 51 is fitted in the threaded hole 59. More specifically, the opening adjusting member 63 is provided with an inner housing 64 which is threadedly engaged with the threaded hole 59, an outer housing 66 fixed to the inner housing 64 through a diaphragm 65, and a plunger (temperature-sensing rod) 67 disposed on the body block 46 side with respect to the diaphragm 65. A rod portion 68 of the plunger 67 extends through the plunger hole 60 and the third refrigerant passage 58, and an inner end portion thereof is inserted slidably into the plunger hole 61. Both end portions of an actuating rod (valve rod) 69 are inserted movably into the rod hole 62 and the expansion orifice 51. One end (the rightmost end in the figure) of the actuating rod 69 is in abutment with the plunger 67, an intermediate portion thereof is exposed to the interior of the second refrigerant passage 50, and an opposite end thereof is in abutment with the valve body 54 in the expansion orifice 51.

The housing 66 and the diaphragm 65 form a heat-sensing chamber 70 therebetween and the housing 64 and the diaphram 65 form a refrigerant chamber 71 therebetween. A pipe 72 is connected to the outer housing 66, through which an inert gas is introduced into the heat-sensing chamber 70.

The expansion valve 42 constructed as above operates as follows.

The compressed refrigerant discharged from the compressor 43 is condensed in the condenser 44, then passes through the receiver 45 and the first refrigerant passage 48 and is introduced into the valve chamber 47. The refrigerant then passes through the expansion orifice 51. At this time, the refrigerant undergoes an adiabatic expansion and becomes a refrigerant of gas-liquid two phases, which then reaches the second refrigerant passage 50. Thereafter, the refrigerant passes through the passage 50 and the circular recess 49 and is introduced into the evaporator 41, in which it is gasified into a gaseous refrigerant. At this time, the evaporator is cooled by the gaseous refrigerant for cooling the interior of the passenger compartment. Further, the gaseous refrigerant discharged from the evaporator 41 passes through the third refrigerant passage 58 and again returns to the compressor 43.

Since a part of the plunger 67 is exposed to the interior of the third refrigerant passage 58, the heat of the gaseous refrigerant passing through the passage 58 is transferred to the diaphragm 65 through the plunger 67 which is made of aluminum high in thermal conductivity and is further transferred to the inert gas in the heat-sensing chamber 70, whereby the inert gas is expanded and contracted. Thus, the gas pressure in the chamber 70 changes according to the refrigerant temperature on the outlet side of the evaporator 41 and it acts on the outside surface of the diaphragm 65.

The plunger 67 is urged at all times by means of the compression coiled spring 57 through the valve holder 53, valve body 54 and actuating rod 69. Consequently, the position (opening of the expansion orifice 51) of the valve body 54 relative to the valve seat 52 is held in a position in which the biasing force of the coiled spring 57 as well as the refrigerant pressure in the refrigerant chamber 71, and the gas pressure in the heat-sensing chamber 70, are balanced. The amount of the refrigerant to be fed to the evaporator 41 is adjusted according to the opening of the orifice 51.

The expansion valve 42 has a water removing device for removing the water contained in the refrigerant in a refrigerating cycle. The following description is about the water removing device.

As shown in FIGS. 1 and 2, a generally cylindrical cooling cylinder 73 is fitted in the circular recess 49 formed in the body block 46 of the expansion valve 42 and it is fixed with a joint 74. An O-ring 75 is fitted in the outer periphery of the joint 74 to ensure a hermetic seal. A spiral groove 76 is formed in the outer peripheral surface of the cooling cylinder 73 so that the gaseous refrigerant can pass through the space formed between the groove 76 and the inner wall of the circular recess 49. Further, a first by-pass 77 is formed between the circular recess 49 of the body block 46 and the third refrigerant passage 58, and one end of the by-pass 77 is open to the third refrigerant passage 58 on an upstream side with respect to the plunger 67, while an opposite end thereof is open to the inner wall of the circular recess 49 for communication with the spiral groove 76 of the cooling cylinder 73.

Figure 3:
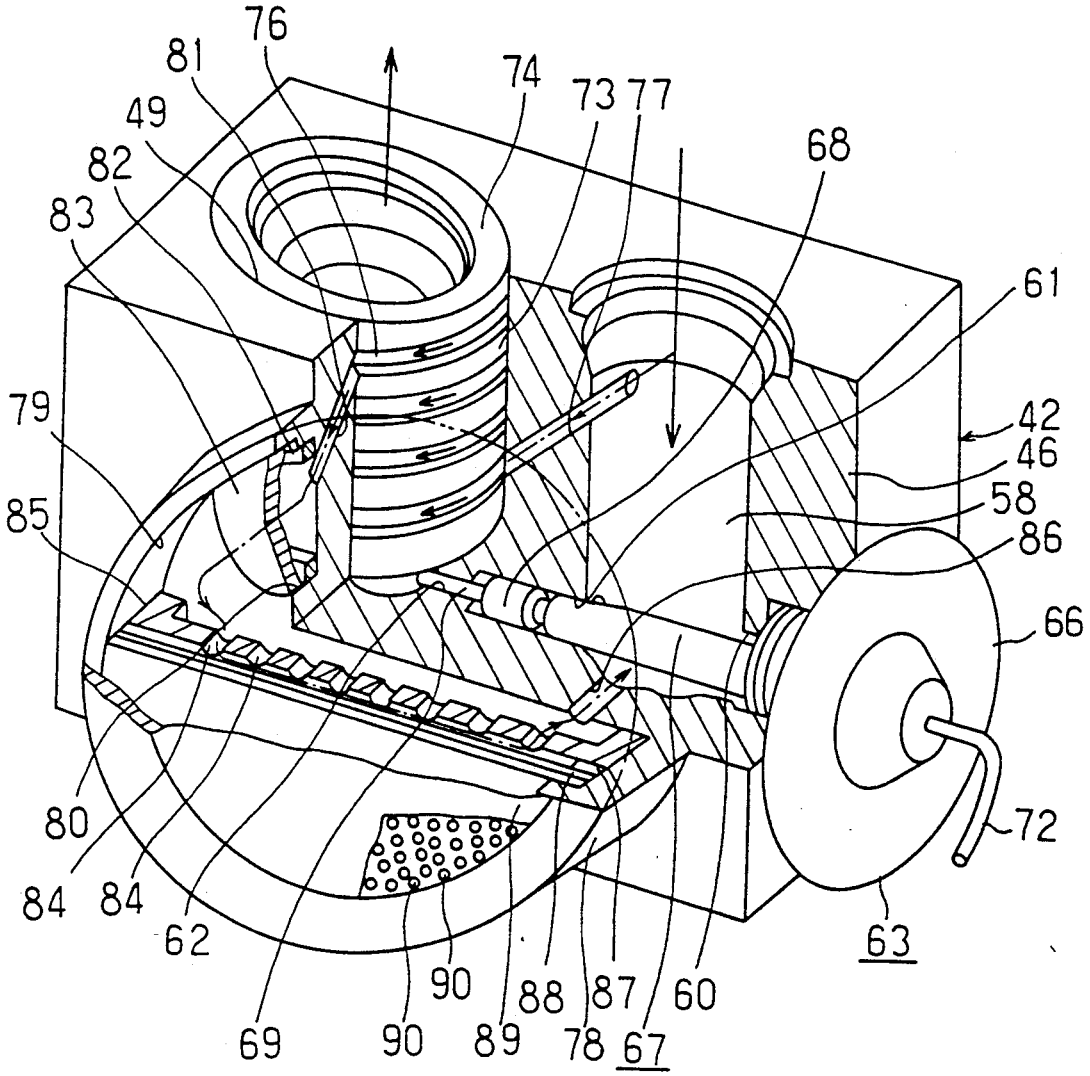
FIG. 3 is a partially cut-away perspective view showing an internal construction of the box-shaped expansion valve.
Figure 4:
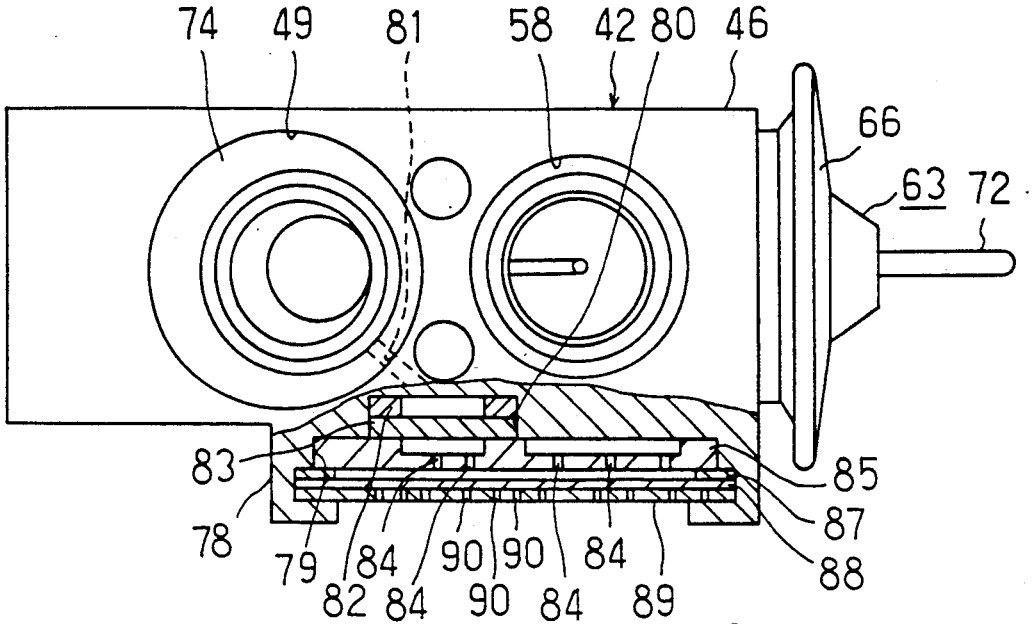
FIG. 4 is a partially cut-away plan view of the box-shaped expansion valve.
Figure 5:
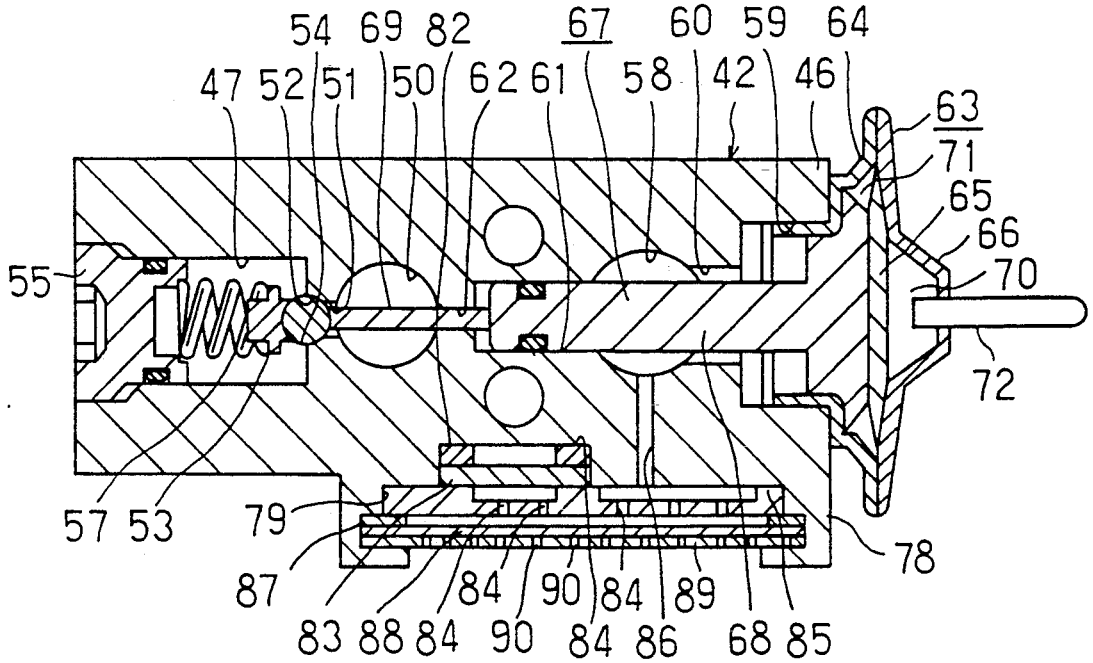
FIG. 5 is a sectional plan view of the box-shaped expansion valve.

As shown in FIGS. 2 to 4, moreover, a cylindrical portion 78 is provided projectingly on the front side of the body block 46. The interior of the cylindrical portion 78 serves as a water discharge passage 79. A circular recess 80 is formed in a base end portion of the water discharge passage 79, the recess 80 being in communication with the spiral groove 76 through a second by-pass 81.

A disk-shaped filter 83 is disposed within the recess 80 as a water collector through a spacer 82. The filter 83 is constituted by glass wool. Outside the filter 83, a presser plate 85 having a large number of holes is disposed in the interior of the cylindrical portion 78. Further, the water discharge passage 79 formed in the cylindrical portion 78 is in communication with the third refrigerant passage 58 through a third by-pass 86 on a downstream side with respect to the plunger 67. In the front portion of the interior of the cylindrical portion 78 there are disposed in a stacked state a packing 87, a water permeating membrane 88 and a presser plate 89 having a large number of holes 90. These members are fixed by caulking the outer periphery of the front end of the cylindrical portion 78. The water permeating membrane 88 is positioned between the air and the refrigerant passage. The membrane 88 is formed of a polyimide resin and functions to pass only water, not allowing gaseous refrigerant to pass therethrough. The presser plate 89 reinforces the strength of the water permeating membrane 88 (the refrigerant pressure is approximately 6 kgf/cm$^2$ when the air conditioner is off).

The presser plate 85 supports not only the filter 83 under pressure but also the water permeating membrane 88 to prevent an inward deformation of the membrane when drawing a vacuum at the time of charge of the refrigerant in the refrigerating cycle.

Figure 6:
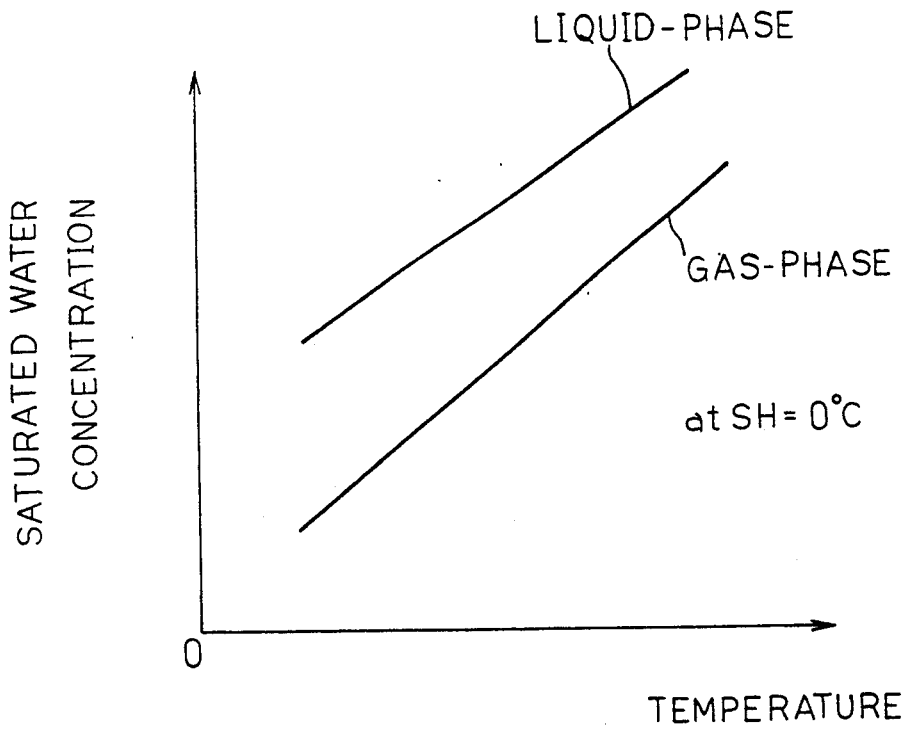
FIG. 6 is a diagram showing a relation between temperature and saturated water concentration in a refrigerant.
Figure 7:
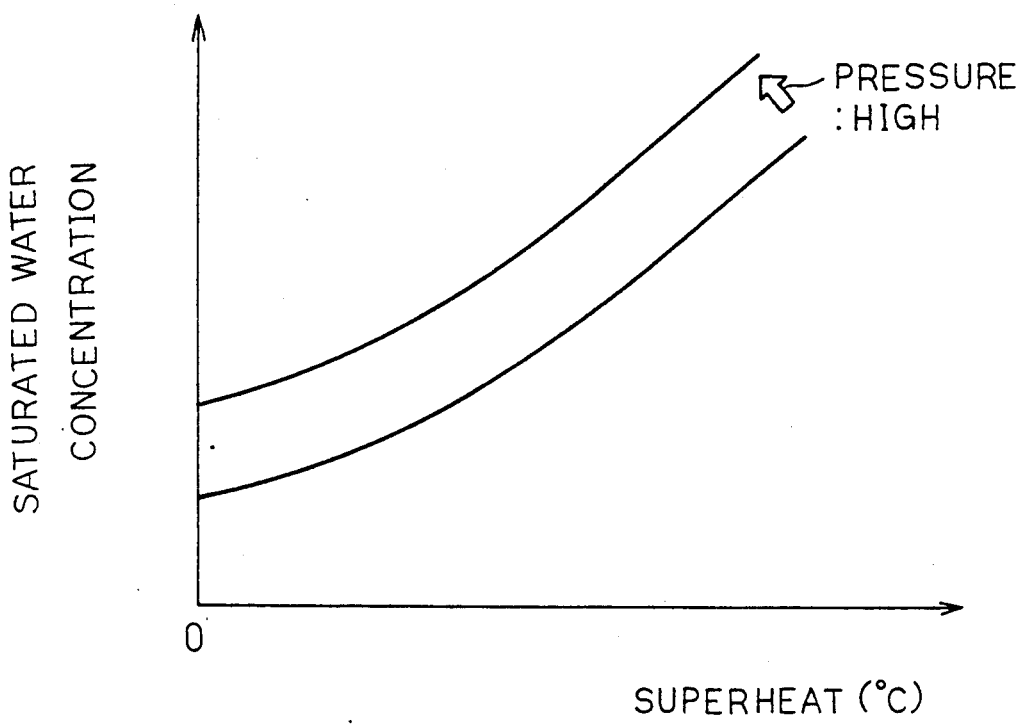
FIG. 7 is a diagram showing a relation between the degree of superheat and a saturated water concentration in the refrigerant.

Freon-134a (tetrafluoroethane) or Freon-22 (chlorodifluoroethane) for example, is used as the refrigerant in the refrigerating cycle. The saturated water concentrations of these refrigerants are lower in gas phase than in liquid phase as shown in FIG. 6.

The operation of the water removing device having the above construction is described below.

As the refrigerant begins to circulate in the refrigerating cycle, the water is separated from the liquid phase refrigerant at the time of evaporation of the refrigerant in the evaporator 41 and misty water is suspended in the gas phase refrigerant.

The amount of water dissolved in the gaseous refrigerant depends on pressure and temperature thereof. The higher the pressure or the higher the temperature, the larger the amount of water is dissolved in the refrigerant (see FIG. 7). The gaseous refrigerant is superheated at the outlet of the evaporator 5 and the refrigerant discharged from the evaporator 5 contains extra water corresponding to the degree of superheat.

In the third refrigerant passage 58 in the expansion valve 42, the pressure in the upstream side becomes higher than that in the downstream side with respect to the plunger 67 due to pressure loss of the plunger. Consequently, a part of the gaseous refrigerant in the upstream side of the plunger 67 flows into the first by-pass 77 and flows through the spiral groove 76 of the cooling cylinder 73. At this time, since the refrigerant of gas-liquid phases which has expanded adiabatically in the expansion orifice 51 is flowing through the cooling cylinder 73, the refrigerant in a gaseous phase flowing in the spiral groove 76 is cooled by the saturated liquid (degree of superheat: 0° C.) passing through the cooling cylinder 73. In this embodiment, the refrigerant having a degree of superheat 10° C. is cooled to a degree of superheat at 2° C. As a result of such cooling of the refrigerant, the water is separated from the refrigerant.

The gaseous refrigerant which has been cooled in the cooling cylinder 73 passes through the filter 83 via the second by-pass 81. At this time, since glass wool is highly wettable for water, the separated water is collected by the filter 83. More specifically, the separated water arose due to the difference of the saturated water concentration between liquid phase and gas phase of the refrigerant and the separated water arose by cooling of the refrigerant in the cooling cylinder 73 are collected.

The gaseous refrigerant after the collection of the separated water passes through the holes 84, then flows through the third by-pass 86 and is returned to the third refrigerant passage 58 on the downstream side of the plunger 67, that is, returned to the main passage in the refrigerating cycle. The water collected by the filter 83 is discharged into the air after the air conditioner stops operation thereof. While the air conditioner is in operation (in the refrigerating cycle operation), the surface temperature of the water permeating membrane 88 becomes low (about 5° C.) and the steam in the air is condensed, so the partial pressure of steam inside the membrane 88 and that outside the membrane become equal to each other and hence the water collected by the filter 83 cannot be discharged into the air. Thereafter, when the air conditioner stops operation (end of the refrigerating cycle), the condensed water outside the water permeating membrane 88 is extinguished. At this time, the inside of the membrane 88 becomes higher in the partial pressure of steam than on the outside because of 100% humidity, so that the water collected by the filter 83 is discharged from the membrane 88 into the air through the holes 84 of the presser plate 85.

Thus, in the water removing device of this embodiment, Freon-134a or Freon-22 is used as the refrigerant of which the saturated water concentration is lower in a gas phase than in liquid phase; the by-passes 77, 81 and 86 for by-passing a part of the refrigerant evaporated in the evaporator 41 are formed in the body block 46 of the expansion valve 42; and the filter (water collector) 83 for collecting the water contained in the refrigerant is disposed halfway in the by-passes 77, 81 and 86. Consequently, upon increase in the water concentration of the refrigerant, the water dissolved in the refrigerant in a liquid state is separated at the time of evaporation and misty water is suspended in the refrigerant in a gaseous state, then a portion of the gaseous refrigerant containing the separated water enters the by-pass 77 and the a water is collected by the filter 83. In the conventional device using a cold trap, it is necessary to provide a device for obtaining an ultra-low temperature and it has been difficult to apply it to an equipment where the mounting space is limited such as an automobile air conditioner. On the other hand, in this embodiment, the water removing function can be attained merely by forming by-passes in the body block 46 of the expansion valve 42 and disposing the filter 83 therein, thus making it possible to obtain a simple and compact structure. Besides, the laying of a water separating pipe is not necessary at all and hence the piping system is not complicated.

The cooling cylinder 73 for cooling the refrigerant is disposed halfway in the by-passes 77, 81 and 86 and the filter 83 is disposed downstream of the cylinder. The amount of water dissolved in the refrigerant which is in a gaseous phase depends on pressure and temperature, and at the outlet of the evaporator 41 the gaseous refrigerant has degree of superheat, so a portion of misty water arose in the evaporator 41 is dissolved in the gaseous refrigerant, but the water is separated by cooling in the cooling cylinder 73 and can be collected by the filter 83. In this connection, any special cooling device is not separately provided as the refrigerant coolers but there is used the cooling cylinder 73 which utilizes the low temperature-side refrigerant in the refrigerating cycle, so there can be attained a simple and compact structure.

Further, the water permeating membrane (a specific substance permeating membrane) 88 is disposed halfway in the water discharge passage 79 for permitting the passage of only water, not permitting the passage of the refrigerant, while the refrigerating cycle is off, and discharging the water in the filter 83 which has been collected in the refrigerating cycle into the air. Thus, the water contained in the refrigerant can be removed permanently without the necessity of providing any special equipment for the discharge of water.

Embodiment 2

Figure 8:
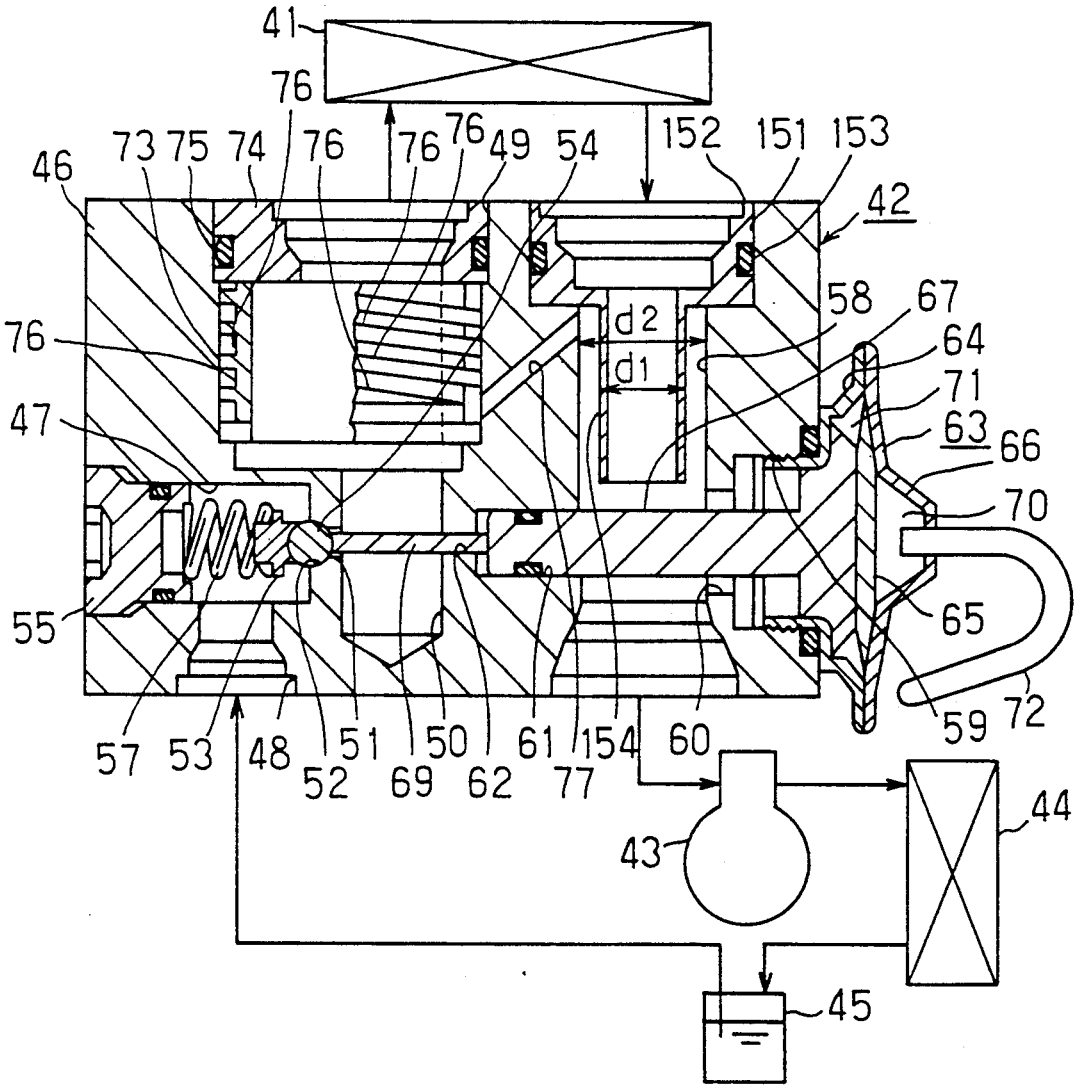
FIG. 8 is a sectional view of a refrigerating system according to a second embodiment of the present invention.

A second embodiment of the present invention is described below with reference to FIG. 8.

A circular recess 151 is formed in an upstream-side opening portion of the third refrigerant passage 58. A separator pipe 152 which constitutes a lubricating oil removing means is fitted in the circular recess 151 and fixed therein, and an O-ring 153 is fitted in the outer periphery of the pipe 152 to ensure a hermetic seal. The separator pipe 152 is formed with a projecting portion 154 extending in the direction of the plunger 67, with a clearance being formed between the outer peripheral surface of the projecting portion 154 and the inner peripheral surface of the third refrigerant passage 58. The portion of the third refrigerant passage 58 located upstream of the plunger 67 is divided into a main refrigerant flow region extending from the interior of the separator pipe 152 to the downstream side of the plunger 67 and a sub refrigerant flow region formed by the said clearance. The sub refrigerant flow region is connected to the branch passage 77. Other constructional points are the same as in the first embodiment.

When the air conditioner starts operating and the refrigerant begins to circulate in the refrigerating cycle, a lubricating oil which circulates together with the refrigerant, because of higher density and mass than those of the refrigerant in a gaseous state, flows straight forward through the projecting portion 154 disposed in the third refrigerant passage 58 together with the gaseous refrigerant. On the other hand, a low mass portion of the gaseous refrigerant containing little lubricating oil, because of low inertia, is branched at a similar flow velocity into the clearance formed between the projecting portion 154 and the inner wall of the third refrigerant passage 58 and reaches the interior of the branch passage 77. Thus, the gaseous refrigerant having a small lubricating oil content is branched and as a result the lubricating oil is separated and removed from a portion of the refrigerant. Further, the gaseous refrigerant in the branch passage 77 passes through the spiral groove 76 of the cooling cylinder 73. At this time, since the refrigerant of gas-liquid phases of a low temperature which has undergone an adiabatic expansion in the expansion orifice 51 is flowing through the cooling cylinder 73, the outer periphery-side gaseous refrigerant having a degree of superheat is cooled under the conduction of heat made by the saturated liquid (degree of superheat: 0° C.) flowing through the cylinder 73, so that water is liberated and separated from the refrigerant. At this time, since the lubricating oil has been removed from the gaseous refrigerant flowing through the spiral groove 76, there is little fear of a lubricating oil film being formed on the inner peripheral surface of the spiral groove 76, so it is possible to always attain a high cooling efficiency and ensure the separation of water.

The third refrigerant passage 58 and the separator pipe 152 are in the following relation to each other.

As shown in the figure, when the outside diameter of the projecting portion 154 is $d_1$ (cm), the inside diameter of the third refrigerant passage 58 is $d_2$ (cm), a main flow rate is G (kg/h), a by-pass flow rate is $G_{by}$ (g/h), the flow velocity in the by-pass portion is $V_2$ (cm/sec), and the density of the refrigerant in a gaseous state is $\rho$ (g/cm$^3$), then $V_2$ is expressed as follows:

$$V_2 = B_{by}/\{900\,\rho\pi\,(d_2^2 - d_1^2)\}$$

when $d_2$ is made large, $V_2$ becomes small, so the lubricating oil separating performance is improved, but at a large $d_2$ value both a pressure loss at the time of decrease from $d_2$ to $d_1$ and that at the time of increase front $d_1$ to $d_2$ become large, resulting in a decrease of the main flow rate G. Therefore, it is necessary to enlarge $d_2$ in a range in which the bad influence on the pressure loss does not become conspicuous.

Thus, in this embodiment, the problem of deterioration in the dehumidifying function caused by the incorporation of a lubricating oil in the refrigerant can be overcome by merely disposing such a simple member as the separator pipe 152 in the body block 46 of the expansion valve 42.

Embodiment 3

Figure 9:
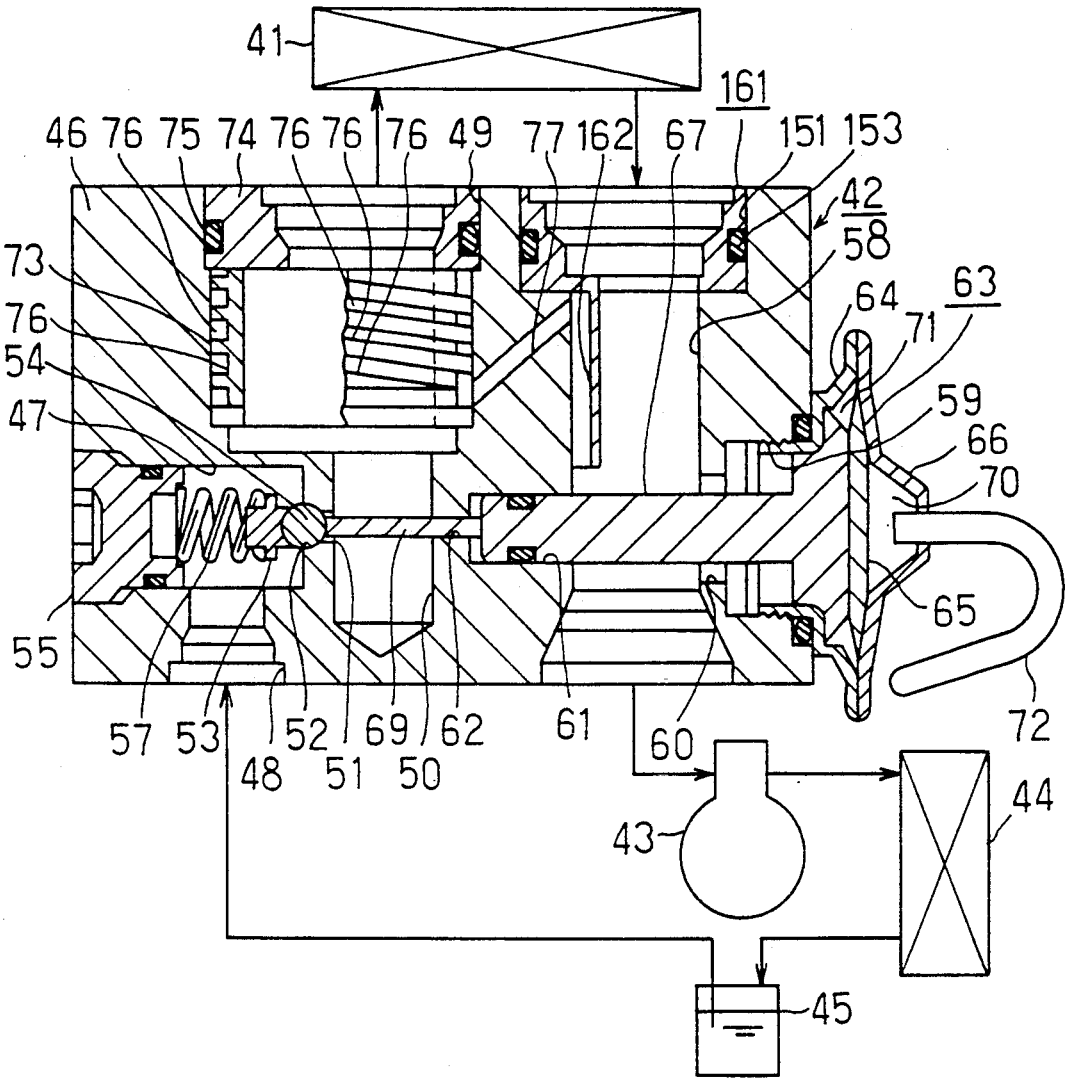
FIG. 9 is a sectional view of a refrigerating system according to a third embodiment of the present invention.
Figure 10:
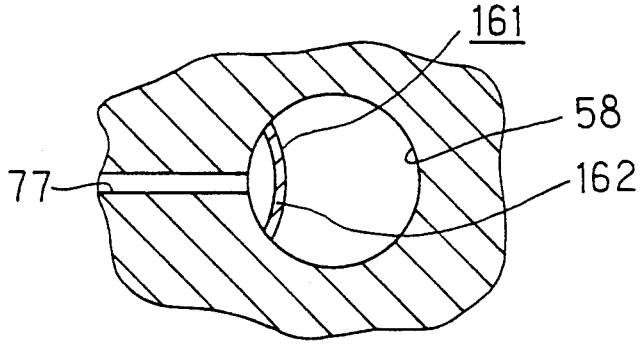
FIG. 10 is a sectional view of a refrigerating system according to a fourth embodiment of the invention.

A third embodiment of the present invention will be described below with reference to FIGS. 9 and 10.

In the third embodiment, in place of the separator pipe 152, an enclosure member 161 having an enclosing portion 162 for enclosing the branch passage 77 is fixed to the third refrigerant passage 58. A clearance is formed between the enclosing portion 162 and the inner peripheral surface of the third refrigerant passage 58, with a plunger 67-side end of the said clearance being open.

Therefore, also in the third embodiment, a branch flow of a gaseous refrigerant which is low in the lubricating oil content is created in the clearance as in the second embodiment, and the branch flow reaches the branch passage 77.

Embodiment 4

A fourth embodiment of the present invention will be described below.

Figure 11:
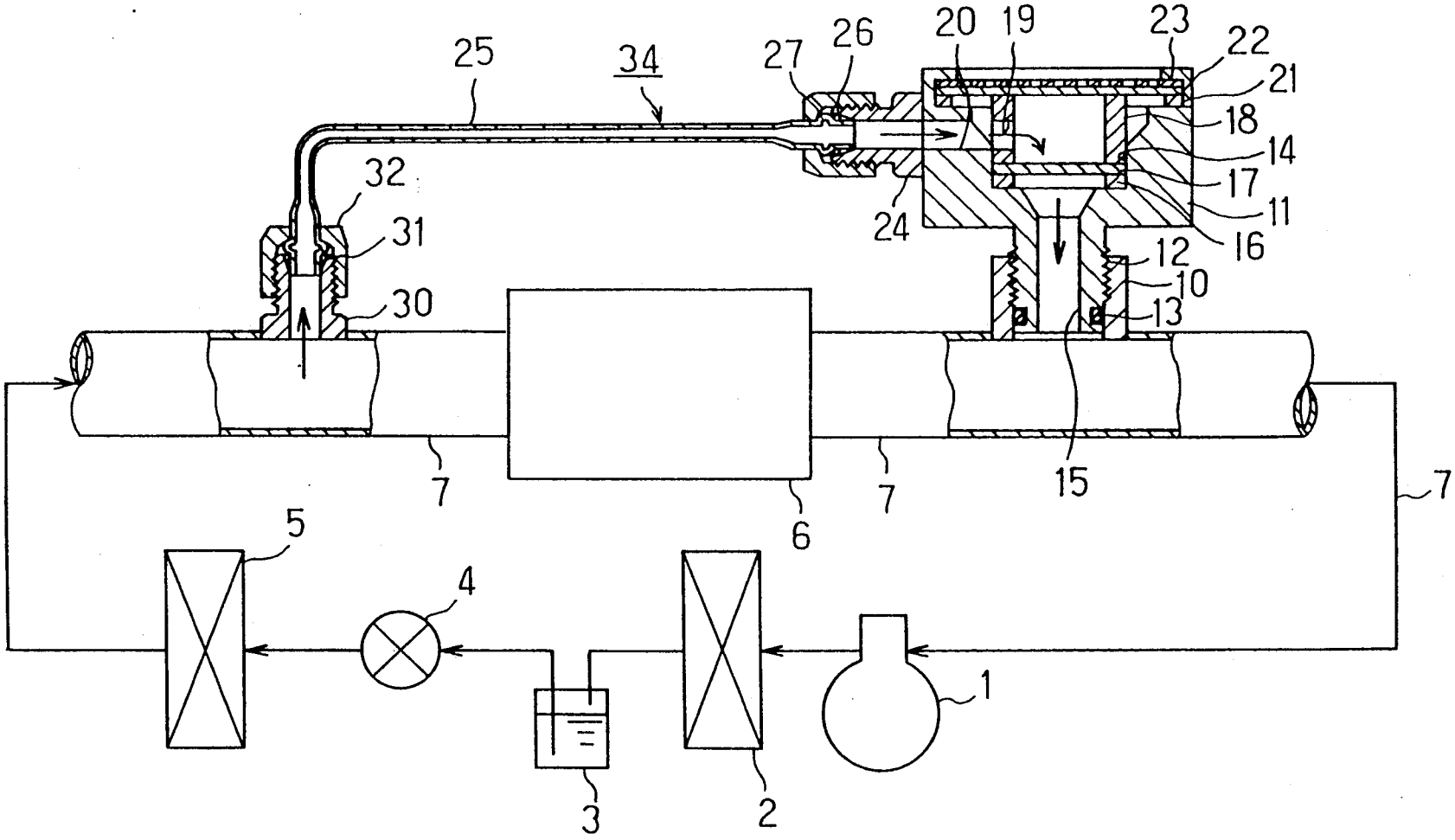
FIG. 11 is a sectional view of a refrigerating system according to a fifth embodiment of the invention.

FIG. 11 illustrates a schematic construction of an automobile air conditioner according to this embodiment. A refrigerating cycle in this air conditioner is constituted by a successive connection through a main pipe 7 of a variable capacity compressor 1, a condenser 2, a receiver 3, a box-shaped expansion valve 4, an evaporator 5 and an evaporative pressure regulating valve 6.

HFC-134a (tetrafluoroethane) or CFC-22 (chlorodifluoroethane) is used as the refrigerant, in this refrigerating cycle.

In the refrigerating cycle constituted as above, the refrigerant discharged from the compressor 1, which is in a highly compressed state, is condensed by the condenser 2 and is introduced into the expansion valve 4 through the receiver 3, like the first embodiment. While passing through the expansion valve 4, the refrigerant is expanded adiabatically into a gas-liquid phase refrigerant. Then, the refrigerant is introduced from the expansion valve 4 into the evaporator 5, in which it is gasified into a gaseous refrigerant. At this time, the evaporator 5 is cooled by the gaseous refrigerant for cooling the passenger compartment. The gaseous refrigerant discharged from the evaporator 5 flows through the main pipe 7 and is returned to the compressor 1. The evaporative pressure regulating valve 6 is for preventing the frosting of the evaporator 5 under operation at a small heat load. The valve 6 throttles the refrigerant from the evaporator 5 to the compressor 1 continuously to maintain the evaporative pressure in the evaporator at 1.9 kgf/cm$^2$ or higher.

In this refrigerating cycle there is provided a water removing device for the removal of water contained in the refrigerant, which device will be described below.

A connection cylinder 10 is connected and fixed to the main pipe 7 which connects an outlet side of the evaporative pressure regulating valve 6 and an inlet side of the compressor 1, and a connecting portion 12 of a housing 11 is threadedly fitted in the connection cylinder 10, with a hermetic seal being ensured by a seal ring 13. In the housing 11 is formed a recess 14 which serves as an expansion chamber having an open upper surface and which is in communication with the interior of the main pipe 7 through a passage 15 formed on the bottom side of the recess. Within the recess 14 is disposed a spacer 16, on which is disposed a disk-shaped filter 17 of glass wool serving as a water collector, and further on the filter 17 there is disposed a presser cylinder 18. A through hole 19 is formed in the presser cylinder 18 and it is in communication with a through hole 20 formed in the side wall portion of the recess 14. In the opening portion of the recess 14 there are disposed in a stacked state a spacer 21, a water permeating membrane 22 and a presser plate 23, which members are fixed by caulking the outer periphery of a front end of the housing 11. The water permeating membrane 22 is formed of a polyimide resin and functions to pass only water therethrough, not permitting the passage of gaseous refrigerant. The presser plate 23 is constituted by a circular stainless steel plate having a large number of holes 1 mm or so in diameter and having a percentage opening of 25%. The presser plate 23 reinforces the strength of the water permeating membrane 22.

To an outer side face of the housing 11 is connected and fixed a connection pipe 24 which is in communication with the through hole 20. Connected to the connection pipe 24 is a capillary tube 25, which is fixed with a nut 27 through an O-ring 26.

On the other hand, a connection pipe 30 is connected and fixed to the main pipe 7 which connects an outlet side of the evaporator 5 and an inlet side of the evaporative pressure regulating valve 6. The connection pipe 30 and the capillary tube 25 are connected and fixed together with a nut 32 through an O-ring 31. Thus, a by-pass 34 for branching a portion of the refrigerant from the main pipe 7 is composed of the connection pipe 30, capillary tube 25, connection pipe 24, housing 11 and connection cylinders 10.

The operation of the water removing device constructed as above will be described below.

In the normal state in which the air conditioner is operating, the refrigerant is circulating in the refrigerating cycle and the evaporative pressure regulating valve 6 is in operation, the refrigerant flows on an upstream side of the valve 6 at a pressure of 1.9 kgf/cm$^2$, while the pressure on a downstream side of the valve 6 is below 1.9 kgf/cm$^2$ due to a pressure loss induced by the valve 6 and the main pipe 7. In the presence of this pressure difference, a portion of the refrigerant flowing through the main pipe 7 passes through the capillary tube 25, through-hole 20, through-hole 19 of the presser cylinder 18 and passage 15 and is returned to the main pipe on the downstream side of the evaporative pressure regulating valve 6. At this time, the refrigerant which has passed through the capillary tube 25 is expanded adiabatically in the recess 14 and thereby comes to have a temperature of not higher than 0° C. As a result, water is formed from the refrigerant and freezes because the temperature of the surrounding refrigerant is not higher than 0° C. The resulting ice is collected by the filter 17.

While the air conditioner is in operation (in the refrigerating cycle operation), the surface temperature of the water permeating membrane 22 becomes low (about 5° C.) and the steam in the air is condensed, so that the partial pressure of steam inside the membrane 22 and that outside the same membrane become equal to each other, and hence the water collected by the filter 17 cannot be discharged into the air.

Thereafter, upon turning off of the air conditioner (end of the refrigerating cycle), the condensed water which has been present outside the water permeating membrane 22 is extinguished. At this time, the inside of the membrane 22 is 100% in humidity, so the partial pressure of steam becomes higher than that on the outside. Consequently, the water which has been collected by the filter 17 passes through the membrane 22, then through the holes formed in the presser plate 23 and is discharged into the air.

Thus, in the water removing device of this fourth embodiment, HFC-134a or CFC-22, having a saturated water concentration lower in gas phase than in liquid phase, sealed as the refrigerant in the refrigerating cycle, and a portion of the refrigerant evaporated in the evaporator 5 is by-passed using the capillary tube 25 (by-pass 34), further, the filter (water collector) 17 for collecting the water contained in the refrigerant is disposed halfway in the by-pass 34. Therefore, with increase of the water concentration in the refrigerant and at the time of evaporation in the evaporator 5, the water which has been dissolved in liquid refrigerant is separated and misty water is suspended in gaseous refrigerant. A portion of the gaseous refrigerant containing the separated water enters the by-pass 34 and the misty water is collected by the collector 17.

In the water removing devices in question moreover, the refrigerant is expanded adiabatically in the housing 11 and is then passed through the filter 17. More particularly, when the evaporative pressure regulating valve 6 is in operation, since the refrigerant at the outlet of the evaporator is in the state of gas-liquid two phases, the refrigerant is cooled by adiabatic expansion and water is separated, which water can be collected by the filter 17. Therefore, unlike the prior art, it is not necessary to use complicated devices, including a cold trap, and an adiabatic expansion is sure to occur, thereby permitting the collection of water, if only a refrigerant flow is present, without being influenced by variations in cooling load, etc.

Further, the water permeating membrane 22 is disposed halfway of the opening portion (water discharge passage) of the recess 14, permitting only water to pass therethrough, not permitting the passage of the refrigerant, when the refrigerating cycle is off. When the refrigerating cycle is on, the water which has been collected by the filter 17 is discharged into the air. As in the first embodiment, the collected water is sure to be removed. In this fourth embodiment, unlike the prior art, since the by-pass 34 is merely connected between the inlet side and the outlet side of the evaporative pressure regulating valve 6, the piping system used is not complicated.

Fifth to twelfth embodiments of the present invention will be described below. The following descriptions cover only different points from the fourth embodiment.

Embodiment 5

Figure 12:
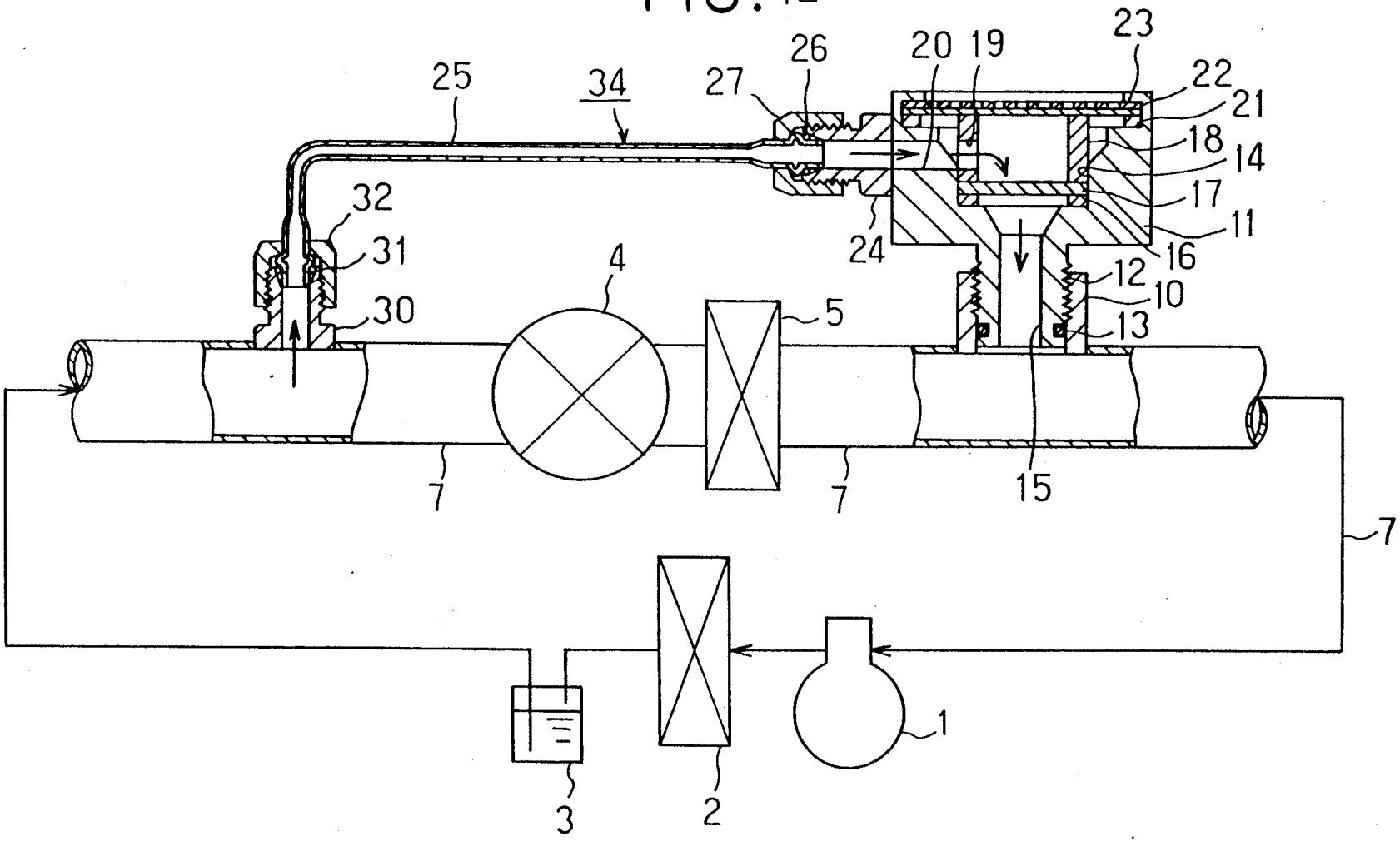
FIG. 12 is a sectional view of a refrigerating system according to a sixth embodiment of the invention.

As shown in FIG. 12, the inlet side (connection pipe 30) of the by-pass 34 is connected to the main pipe 7 in a position between the outlet side of the receiver 3 and the inlet side of the expansion valve 4, while the outlet side (connection cylinder 10) of the by-pass passage 34 is connected to the main pipe 7 in a position between the outlet side of the evaporator 5 and the inlet side of the compressor 1. The evaporative pressure regulating valve 6 is sometimes not used in an actual automobile air conditioner, so the following description is based on the assumption that the evaporative regulating valve 6 is not used.

In the water removing device constructed as above, a portion of the refrigerant flowing out of the receiver 3 enters the by-pass 34 due to a pressure difference between the upstream side of the expansion valve 4 and the downstream side of the evaporator 5. Then, the refrigerant which has passed through the capillary tube 25 of the by-pass 34 is expanded adiabatically in the recess 14 and becomes a gaseous or gas-liquid two-phase refrigerant of low temperature and pressure. Water is produced as a result of such gasification and drop of temperature and it is collected by the filter 17.

The refrigerant after removal of the water is returned from the outlet side of the by-pass 34 to the main pipe 7 on the downstream side of the evaporator 5.

Embodiment 6

Figure 13:
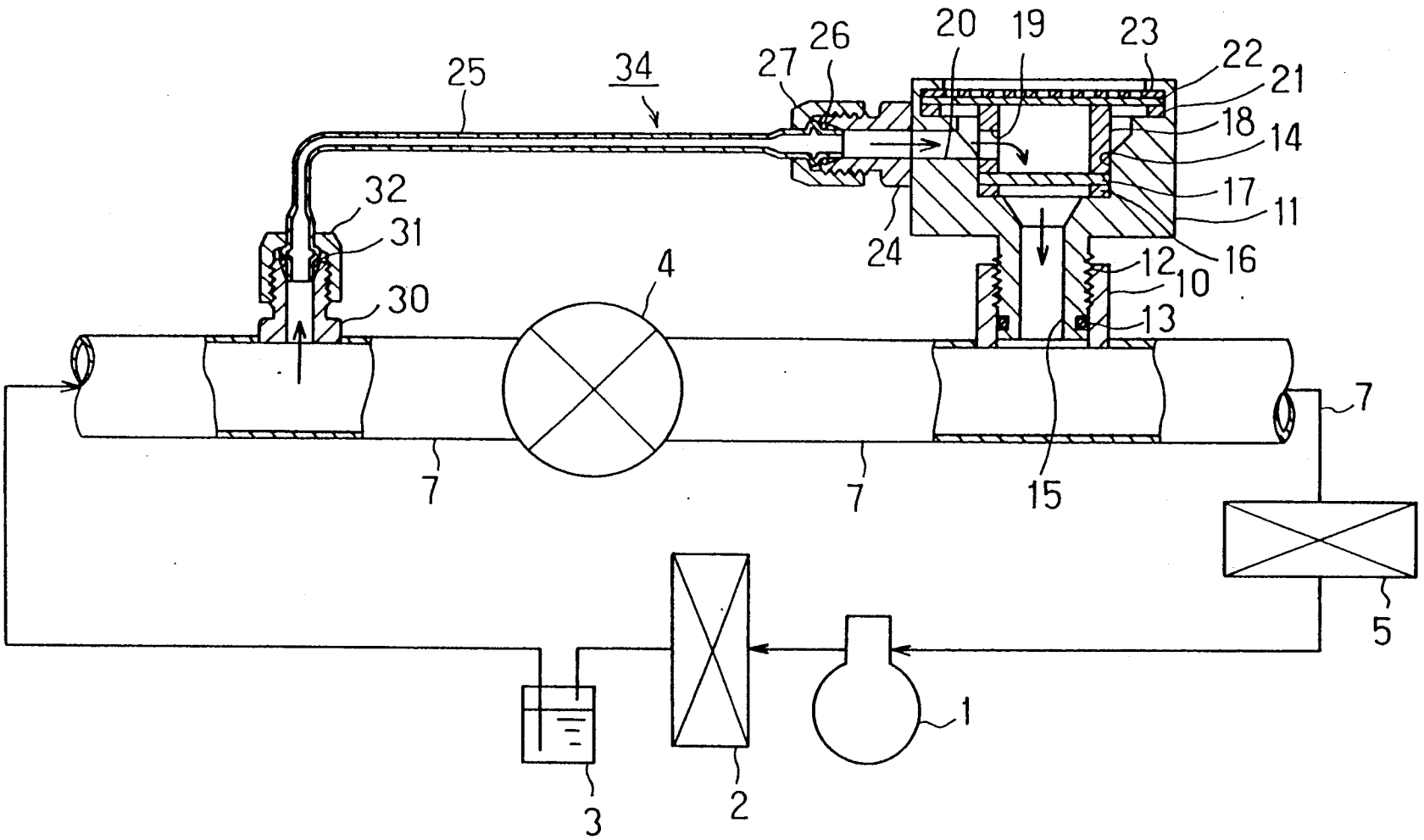
FIG. 13 is a sectional view of a refrigerating system according to a seventh embodiment of the invention.

As shown in FIG. 13, the inlet side of the by-pass 34 is connected to the main pipe 7 in a position between the outlet side of the receiver 3 and the inlet side of the expansion valve 4, while the outlet side of the by-pass 34 is connected to the main pipe 7 in a position between the outlet side of the expansion valve 4 and the inlet side of the evaporator 5.

In the water removing device constructed as above, a portion of the refrigerant flowing out of the receiver 3 enters the by-pass 34. Then, the refrigerant which has passed through the capillary tube 25 of the by-pass 34 is expanded adiabatically in the recess 14 and becomes a gaseous or gas-liquid two-phase refrigerant of low temperature and pressure. As a result of this such a gasification and drop of temperature, water is produced and is collected by the filter 17. The refrigerant after removal of the water is returned from the outlet side of the by-pass 34 to the main pipe 7 on the downstream side of the expansion valve 4.

Embodiment 7

Figure 14:
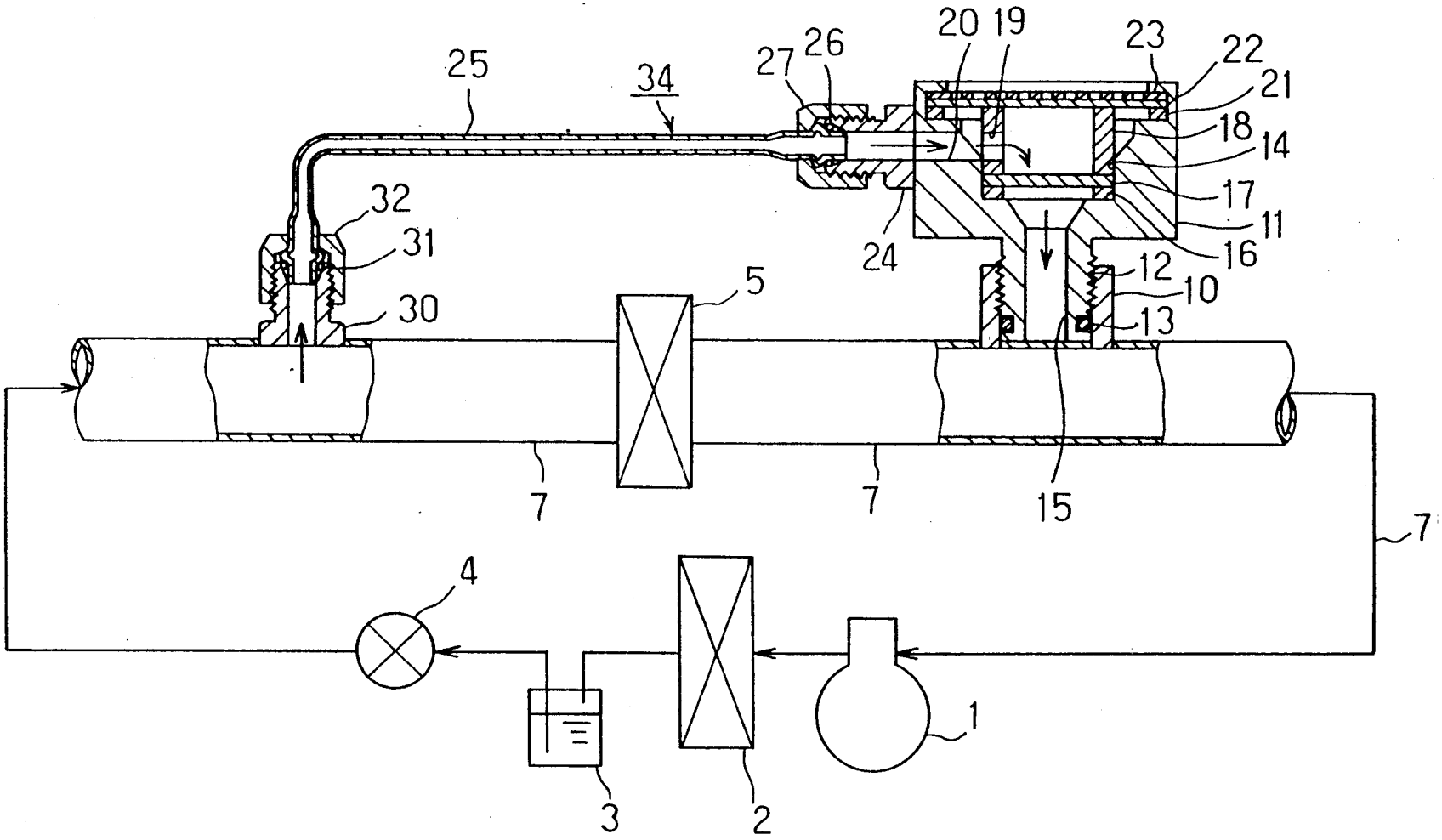
FIG. 14 is a sectional view of a refrigerating system according to an eighth embodiment of the invention.

As shown in FIG. 14, the inlet side of the by-pass 34 is connected to the main pipe 7 in a position between the outlet side of the expansion valve 4 and the inlet side of the evaporator 5, while the outlet side of the by-pass 34 is connected to the main pipe 7 in a position between the outlet side of the evaporator 5 and the inlet side of the compressor 1.

In the water removing device constructed as above, a portion of the refrigerant flowing out of the expansion valve 4 enters the by-pass 34 due to a pressure difference between the upstream side of the evaporator 5 and the downstream side thereof. Then, the refrigerant which has passed through the capillary tube 25 of the by-pass 34 is expanded adiabatically in the recess 14 and becomes a gaseous or gas-liquid phase refrigerant of low temperature and pressure. As a result of such gasification and drop of temperature, water is produced and is collected by the filter 17. The refrigerant after removal of the water is returned from the outlet side of the by-pass 34 to the main pipe 7 on the downstream side of the evaporator 5.

Embodiment 8

Figure 15:
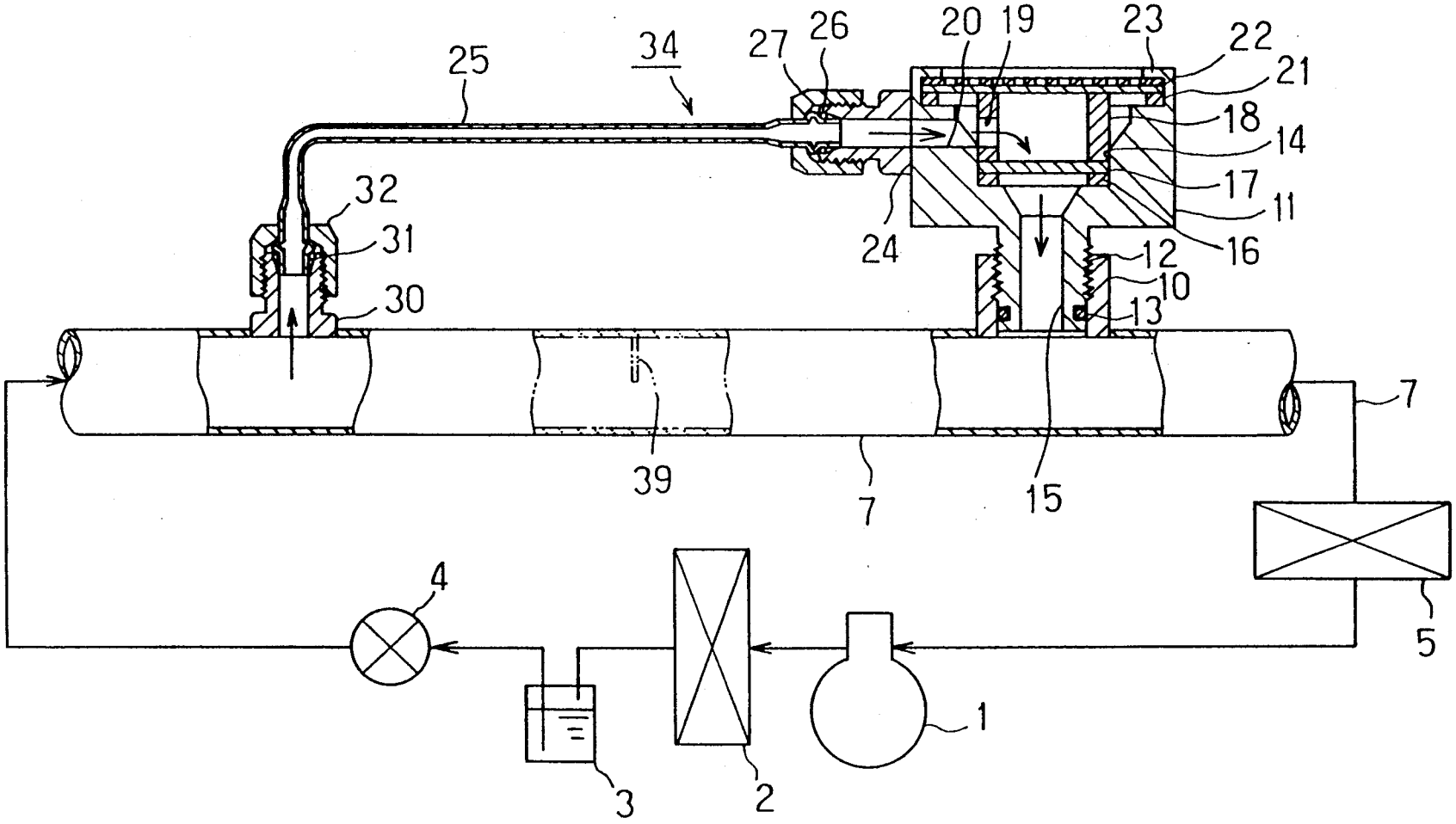
FIG. 15 is a sectional view of a refrigerating system according to a ninth embodiment of the invention.

As shown in FIG. 15, the inlet side of the by-pass 34 is connected to the main pipe 7 in a position between the outlet side of the expansion valve 4 and the inlet side of the evaporator 5, while the outlet side of the by-pass 34 is connected to the main pipe 7 in a position between the outlet side of the expansion valve 4 and the inlet side of the evaporator 5 and downstream of the inlet side of the by-pass 34.

In the water removing device constructed as above, a portion of the refrigerant flowing out of the expansion valve 4 enters the by-pass 34 due to a pressure loss induced by the main pipe 7. Then, the refrigerant which has passed through the capillary tube 25 of the by-pass 34 is expanded adiabatically in the recess 14 and becomes a gaseous or gas-liquid phase refrigerant of low temperature and pressure. As a result of such gasification and drop of temperature, water is produced and collected by the filter 17. The refrigerant after removal of the water is returned from the outlet side of the by-pass 34 to the main pipe 7 downstream of the inlet side of the by-pass.

Embodiment 9

Figure 16:
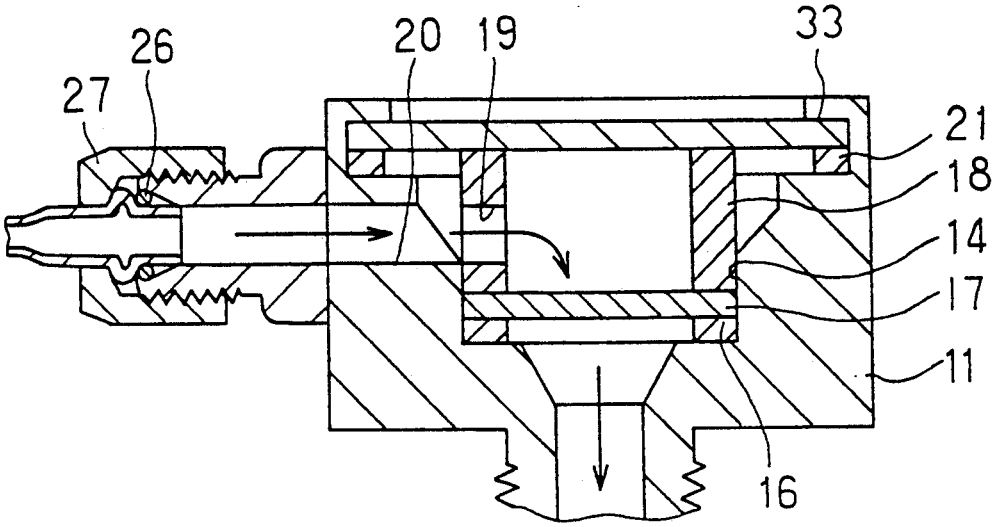
FIG. 16 is a sectional view of a refrigerating system according to a tenth embodiment of the invention.

As shown in FIG. 16, the water permeating membrane 22 which was provided in the opening portion of the recess 14 in each of the above embodiments is removed and instead a cover 33 is used to close the said opening portion.

In this construction, the water collected by the filter 17 cannot be discharged into the air. Consequently, when the refrigerating cycle turns off and the water removing device stops its function, the water once collected is again dissolved in the refrigerant. However, upon start-up of the refrigerating cycle and functioning of the water removing device, the water dissolved in the refrigerant is again separated.

In this embodiment using the cover 33 in place of the water permeating membrane 22, the water contained in the refrigerant repeats dissolution and separation, but while the refrigerating cycle is on, the water is sure to be removed from the refrigerant which is circulating in the refrigerating cycle, so there is no fear of occurrence of inconveniences such as, for example, the deterioration of the cooling performance caused by freezing in the evaporator 5.

Embodiment 10

Figure 17:
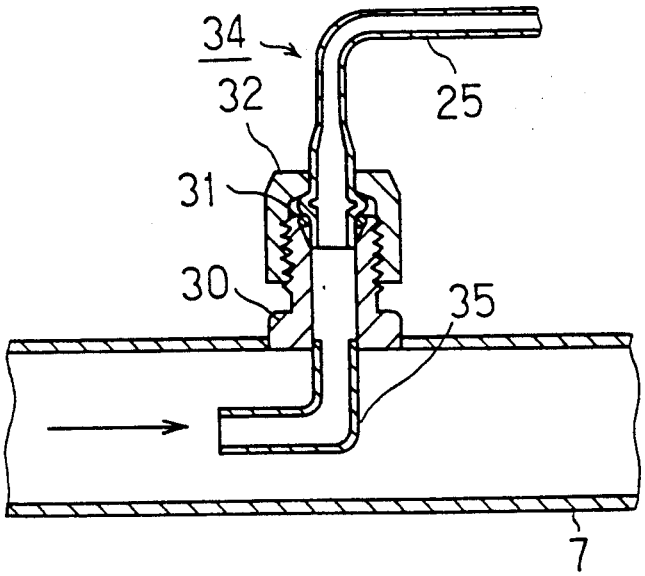
FIGS. 17-19 are detail views of the inlet and outlet of the refrigerating system.

As shown in FIG. 17, an L-shaped inlet pipe 35 is connected to the connection pipe 30 on the inlet side of the by-pass 34 so as to project into the main pipe 7. The inlet pipe 35 is disposed in such a manner that an opening portion thereof faces an upstream side of the refrigerant flow. In this construction, the refrigerant flowing through the main pipe 7 is introduced into the by-pass 34 through the inlet pipe 35 under a dynamic pressure of the refrigerant.

Embodiment 11

Figure 18:
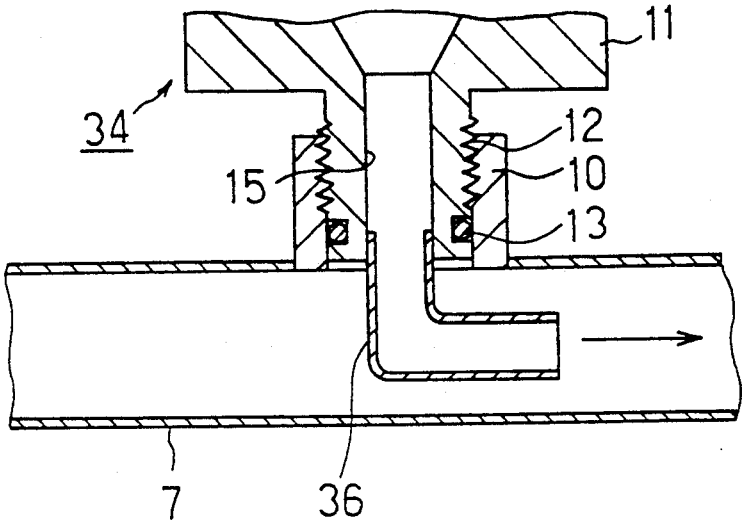

As shown in FIG. 18, an L-shaped outlet pipe 36 is connected to the connection cylinder 10 on the outlet side of the by-pass 34 so as to project into the main pipe 7. The outlet pipe 36 is disposed in such a manner that an opening portion thereof faces a downstream side of the refrigerant flow. In this construction, an ejector effect is created around the outlet pipe 36, whereby the refrigerant present in the by-pass 34 is sucked out from the outlet pipe 36 and the refrigerant in the main pipe 7 is introduced into the by-pass 34 from the inlet side of the by-pass.

Embodiment 12

Figure 19:
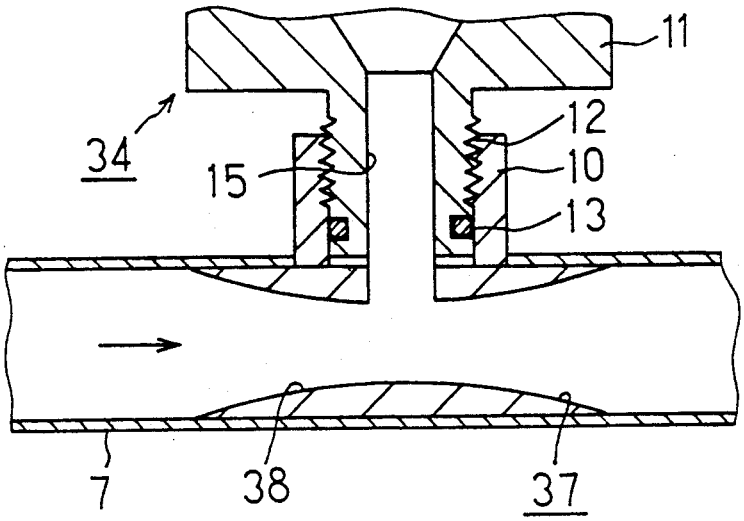

As shown in FIG. 19, a constriction 37 is provided near the front end portion of the connection cylinder 10 on the outlet side of the by-pass 34 in the interior of the main pipe 7, to constitute a Venturi pipe 38. In this construction, the refrigerant present in the by-pass 34 is sucked out under the Venturi effect and the refrigerant in the main pipe 7 is introduced into the by-pass 34 from the inlet side of the by-pass.

COMPARATIVE EXAMPLES

The present invention is not limited to the above embodiments. The following modifications may be adopted.

(1) Although in the first to third embodiments described above the water permeating membrane 88 is provided on the front face of the box-shaped expansion valve 42, it may be disposed in another position, for example, on the bottom of the expansion valve 42.

(2) Although in the first to third embodiments the by-pass is formed in the box-shaped expansion valve 42, it may be branched in the evaporator 41 and connected to the spiral groove 76. In this case, the by-pass should be connected to the spiral groove 76 to by-pass a portion of the refrigerant present in the section from the evaporating portion of the evaporator 41 up to the inlet of the compressor 43.

(3) The by-pass 34 may be disposed in any other position than that in the above embodiments. In this case, when the refrigerant is to be branched from the outlet of the compressor 1, it is necessary to give some consideration for cooling, for example, provide a longer by-pass than the normal one, because of a high temperature of the refrigerant.

(4) In the eighth embodiment shown in FIG. 15, a barrier wall 39 or a constriction may be provided halfway in the main pipe 7 which is in parallel with the by-pass 34, as indicated by a dash-double dot line. In this construction, a large pressure difference is sure to occur between the inlet side and the outlet side of the by-pass 34, whereby the refrigerant can be branched positively.

According to the water removing device of the present invention, there can be attained an excellent effect such that the water contained in the refrigerant can be removed surely without being influenced by variations of the cooling load, by a quite novel and easy method, not requiring any complicated device such as a cold trap or a complicated layer of pipe.

What is claimed is:

1. A water removing device for removing water from a refrigerant for which saturated water concentration is lower in the gas phase than in a liquid phase comprising:

a by-pass passage including a capillary tube for by-passing a part of the refrigerant evaporated in an evaporator; and a water collector which is provided in the by-pass passage and connected to said capillary tube, said water collector being formed with an expansion chamber which causes adiabatic expansion of the refrigerant from said capillary tube to condense water and collect the water contained in the refrigerant.

2. A water removing device according to claim 1, further comprising a cooler for cooling the refrigerant flowing through said by-pass.

3. A water removing device according to claim 1, wherein a permeable membrane for discharging the collected water into the air on the basis of a difference between a partial pressure of steam inside said expansion chamber and that outside the expansion chamber is provided between the air and said expansion chamber.

4. A water removing device for removing water from a refrigerant of which a saturated water concentration is lower in a gas phase than in a liquid phase, comprising:

a by-pass passage including a capillary tube for by-passing a part of the refrigerant flowing through a main pipe of a refrigerating cycle;

an expansion chamber disposed in said by-pass passage and connected to said capillary tube to adiabatically expand the refrigerant passing through said capillary tube; and a water collector member made of glass wool filter disposed in said expansion chamber in a manner to separate said main pipe, thereby collecting the separated water and passing the refrigerant therethrough.

5. A water removing device according to claim 4, further comprising a permeable membrane for passing the collected after therethrough into the air on the basis of a difference between a partial pressure of steam in said expansion chamber and that in the air, and permeable membrane being disposed between the expansion chamber and the air.

6. A water removing device according to claim 4, wherein said by-pass passage is provided between an outlet side of an evaporator and an inlet side of a compressor.

7. A water removing device according to claim 6, wherein said by-pass passage is provided between an upstream side and a downstream side of an evaporative pressure regulating valve.

8. A water removing device according to claim 4, wherein said by-pass passage is provided between an outlet side of a receiver and an inlet side of a compressor.

9. A water removing device according to claim 4, wherein said by-pass passage is provided between an outlet side of a receiver and an inlet side of an evaporator.

10. A water removing device according to claim 4, wherein said by-pass passage is provided between an outlet side of an expansion valve and an inlet side of a compressor.

11. A water removing device according to claim 4, wherein said by-pass passage is provided between an outlet side of an expansion valve and an inlet side of an evaporator.

12. A water removing device refrigerating system for use in a refrigerating cycle using a refrigerant sealed therein which is lower in a saturated water concentration in gas phase than in liquid phase, comprising:

a by-pass passage of a capillary tube type;

an expansion chamber connected to said by-pass passage for adiabatically expanding the refrigerant flowing in a liquid state in said refrigeranting cycle; and a water collector disposed in said expansion chamber to collect the separated water and pass the refrigerant therethrough.

13. A water removing device for removing water from a refrigerant of which a saturated water concentration is lower in gas phase than in liquid phase comprising:

a by-pass passage including a capillary tube for by-passing a part of the refrigerant flowing through a main pipe of a refrigerating cycle;

an inlet pipe for introducing the refrigerant into a by-pass passage, said inlet pipe being disposed on an inlet side of the by-pass passage so as to product into the main pipe;

an expansion chamber disposed in said by-pass passage and connected to said capillary tube to adiabatically expand the refrigerant passing through said capillary tube; and a water collector member made of glass wool filler disposed in said expansion chamber in a manner to separate said expansion chamber from said main pipe, thereby collecting the separated water and passing the refrigerant therethrough.

14. A water removing device for removing water from a refrigerant of which a saturated water concentration is lower in gas phase than in liquid phase comprising:

a by-pass passage including a capillary tube for by-passing a part of the refrigerant flowing through a main pipe of a refrigerating cycle;

an expansion chamber disposed in said by-pass passage and connected to said capillary tube to adiabatically expand the refrigerant passing through said capillary tube;

a water collector member made of glass wool filler disposed in said expansion chamber in a manner to separate said expansion chamber from said main pipe, thereby collecting the separated water and passing the refrigerant therethrough; and an outlet pipe for creating a by-pass flow under an ejector effect, said outlet pipe being disposed on an outlet side of said by-pass passage so as to project into the main pipe.

15. A water removing device for removing water from a refrigerant of which a saturated water concentration is lower in gas phase than in liquid phase comprising:

a by-pass passage including a capillary tube for by-passing a part of the refrigerant flowing through a main pipe of a refrigerating cycle wherein a constriction is provided in the main pipe on an outlet side of said by-pass for increasing the flow velocity of the refrigerant and creating a by-pass flow under a venturi effect;

an expansion chamber disposed in said by-pass passage and connected to said capillary tube to adiabatically expand the refrigerant passing through said capillary tube; and a water collector member made of glass wool filler disposed in said expansion chamber in a manner to separate said expansion chamber from said main pipe, thereby collecting the separated water and passing the refrigerant therethrough.

* * * * *